US005279096A

United States Patent [19]

Mims

[11] Patent Number: 5,279,096

[45] Date of Patent: Jan. 18, 1994

[54] AUTOMATIC ARTICLE PLACER AND PACKER

[75] Inventor: Herman D. Mims, Ellenboro, N.C.

[73] Assignee: Machine Builders and Design Inc., Shelby, N.C.

[21] Appl. No.: 822,282

[22] Filed: Jan. 21, 1992

[51] Int. Cl.[5] ..... B65B 35/36; B65B 35/50

[52] U.S. Cl. ..... 53/447; 53/251; 53/532; 53/537; 53/540

[58] Field of Search ..... 53/443, 447, 532, 534, 53/537, 540, 543, 251, 250, 249

[56] References Cited

U.S. PATENT DOCUMENTS

| | | | |
|---|---|---|---|
| 2,956,384 | 10/1960 | Underwood | 53/537 X |
| 3,641,735 | 2/1972 | Daily et al. | 53/537 |
| 3,928,942 | 12/1975 | Paddock et al. | 53/261 X |
| 4,226,073 | 10/1980 | Rose et al. | 53/532 |
| 4,590,743 | 5/1986 | Hardage | 53/532 X |
| 4,736,570 | 4/1988 | Hardage et al. | 53/532 X |
| 4,768,328 | 9/1988 | Mims | 53/532 |
| 4,949,531 | 8/1990 | Langenbeck et al. | 53/251 X |

*Primary Examiner*—James F. Coan
*Attorney, Agent, or Firm*—Sughrue, Mion, Zinn, Macpeak & Seas

[57] ABSTRACT

The invention relates to an automatic packing system including a station at which a serial stream of articles are placed into stacks (one on top of another) or groups and discharged into a transversely moving tray-type package, or the like. The system includes a conveyor belt for transporting the articles, one by one, while they lie in a horizontal plane. The articles are transferred by another conveyor to a station at the end of the conveyor where the articles are stopped by protruding pins, picked up by a vacuum holding device, transferred by lever mechanisms and carried to a loading station where the articles are dropped one upon another in a stacked manner until an appropriate group has accumulated. When the appropriate group has been accumulated, the bottom of the loading station opens to release the stacked group of articles to fall into its tray-type package, which is moved transversely under the loading station in synchrony with the accumulated articles so as to be directly under the group of dropped articles.

10 Claims, 19 Drawing Sheets

AUTOMATIC ARTICLE PLACER AND PACKER

BACKGROUND OF THE INVENTION

1. Field of the Invention

The invention pertains to an apparatus for conveying and packaging articles. In particular, the invention relates to an apparatus for and process of removing food items from a stream of such items and placing them horizontally one upon another for subsequent packaging in a tray-like package and the like.

2. Background of the Invention

In the preparation of food items such as cookies, candies, and the like, after the cookies have been baked, they are transferred from an oven to a conveyor belt to be conveyed thereby to a packaging station. When the cookies are dropped onto the conveyor belt from the oven, they are arranged randomly. It was the prior practice in the baking industry to manually remove the cookies from the conveyor belt and stack them in appropriate groups (e.g., a group of three stacks, each stack having four cookies) for packaging in a tray- or cup-type package. Obviously, such practice is rather labor-intensive and time consuming.

U.S. Pat. No. 4,768,328 to Mims, the Inventor of the present invention, successfully automated the process of removing cookies from the moving conveyor belt and aligning them in a single group for placement in a tray-package. The disclosed system, known as the TRAY PACKER TM packing system, transports the cookies from the oven and drops them from the conveyor belt, one by one, along a slide. The cookies temporarily vertically lay to rest on an abutment surface and are then stacked vertically by a flipper mechanism. When the appropriate group is accumulated, the cookies are allowed to fall in their vertically stacked positions into a tray-type package. The TRAY PACKER TM packing system, however, requires that the cookies be dropped one by one from the conveyor belt, to form a single stack of cookies. Moreover, the system does not allow the cookies to be placed in packages in horizontal groups.

SUMMARY OF THE INVENTION

It is an object of the present invention to provide an apparatus for and process of automatically conveying, placing and packaging articles, such as cookies, candies, and the like, so that the articles are horizontally stacked one upon another in a package.

It is an object of the present invention to provide an apparatus for and process of automatically placing and packaging articles in a tray-like package that is transversely conveyed and indexed so as to be directly underneath an appropriate group of articles to be packaged.

It is also an object of the present invention to provide an apparatus for and process of automatically placing and packaging articles in a cup-like package or any other type package that can be transversely conveyed and indexed so as to be directly underneath an appropriate group of articles to be packaged.

It is a further object of the present invention to provide an apparatus for and process of automatically grouping articles in a desired group for placing and packaging.

The present invention achieves the foregoing objects by providing an apparatus for and process of receiving in an infeed section a stream of randomly distributed articles, such as food items and the like, so as to unscramble, align, accumulate and synchronize the articles into an indexing device. The indexing device positively aligns and spaces the articles to achieve an accurate positioning of the articles by timed-releasing them onto a transport mechanism, such as an endless loop conveyor belt and the like.

The articles are then transversely transported as a plurality of equally spaced rows in a horizontal plane until they abut against a row of pins aligned at the end of the transport mechanism. The row of pins align the articles in a straight row as well as equally spacing the articles from each other. A transfer mechanism immediately positions itself over the articles thus aligned, and proceeds to remove the articles from the transport plane and deposits them into a collating device. The transfer mechanism may be in the form of a row of spaced apart apertures which allow air to pass into a plurality of vacuum jets. The air that passes through the jets create a vacuum or low pressure area at the lower end of a passage way. The differential in air pressure between the upper and lower surfaces of the article will allow the article to be picked up as the vacuum head is moved upwardly.

The collator device acts as a temporary storage device to allow rows of articles to be deposited one upon another in a horizontally stacked manner. Once a predetermined number of articles are deposited in the collator, i.e., a predetermined number of articles are stacked together, the collator transfers the stored articles in their present state into the desired package type.

The unfilled packages are supplied to a transport mechanism similar to the one described above. The packages are supplied to an indexing section that acts to retard the forward motion of the packages to accumulate and subsequently timed-release such packages onto another transport mechanism. When this mechanism is of the flighted-type (i.e., containing equally spaced lugs throughout the surface of an endless loop-type mechanism), the package is positioned behind a flight and passed to a nudging station. The nudging station operates to advance or nudge the package forward so as to abut the upstream flight and to allow a downstream flight to be positioned therebehind.

DETAILED DESCRIPTION OF THE PREFERRED EMBODIMENTS

FIGS. 1–9 particularly illustrate the apparatus and process of the present invention by which a stream of articles are placed in horizontal stacks and subsequently transferred to a package. The articles hereinafter described are in the form of food items, such as cookies, candies, or the like. Use of such food items in the following description is for illustrative purposes only and should not be considered a limitation of the present invention.

Figure 1A:
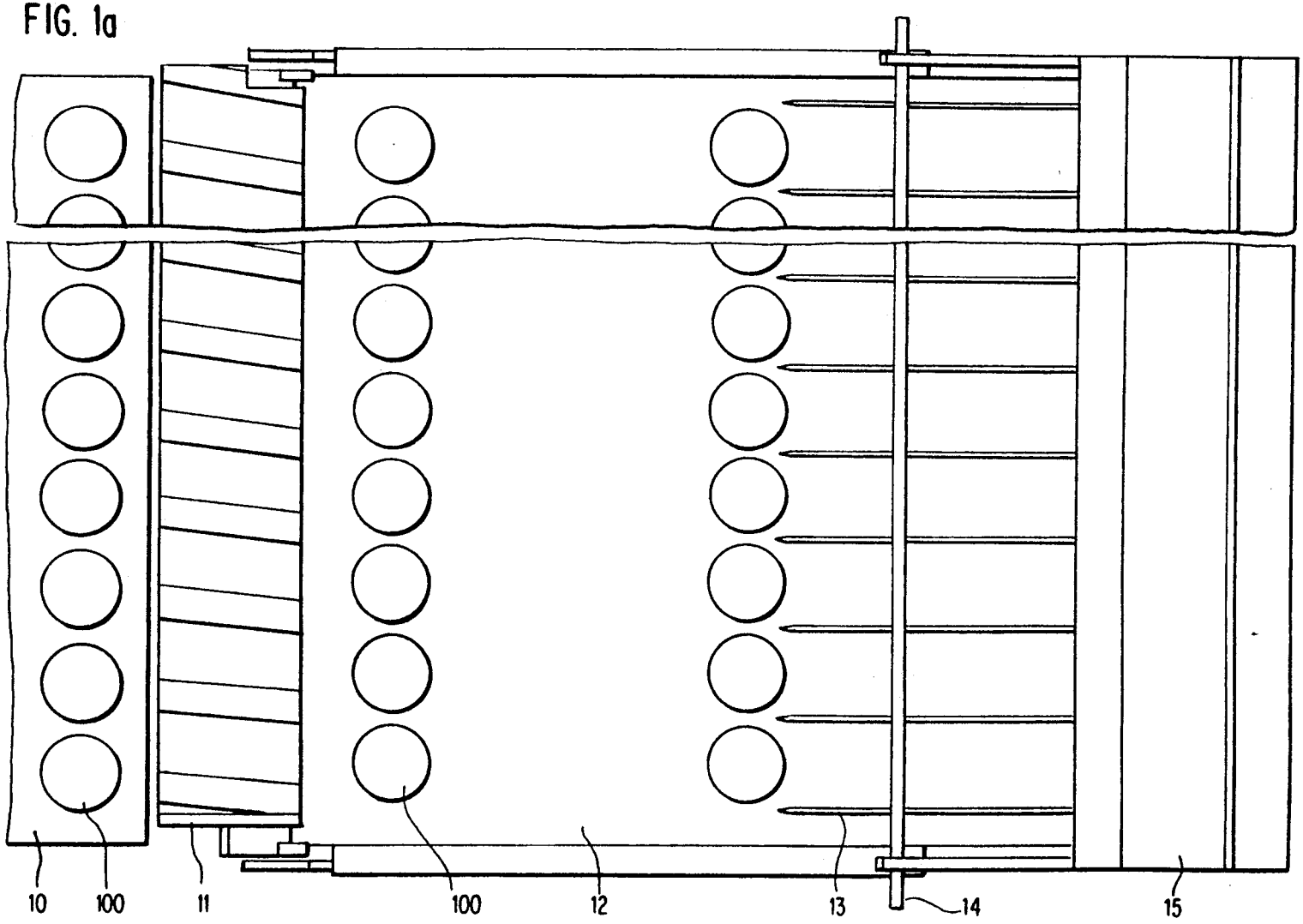
FIGS. 1*a*, 1*b* and 2 illustrate a top view of the apparatus according to the preferred embodiment of the invention.
Figure 1C:
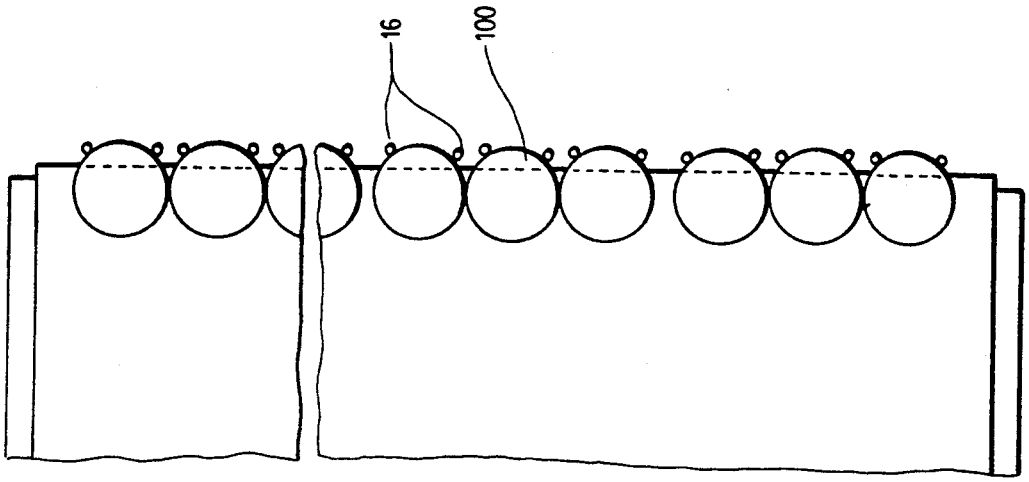
FIG. 1*c* illustrates a top view of the apparatus according to another embodiment of the invention.
Figure 1B:
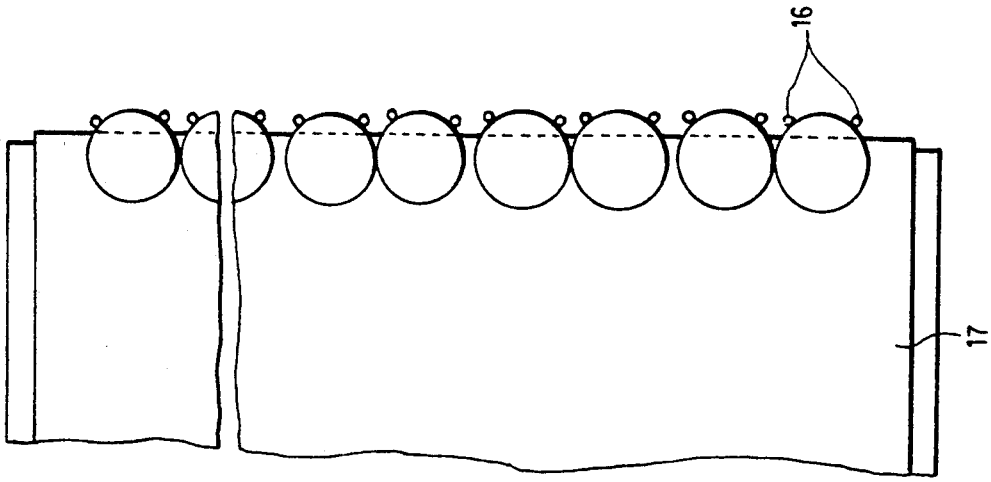

Referring to FIG. 1, there is shown a top view of a plurality of rows of food items, such as cookies 100, which are deposited following baking or other food processing steps to a conveyor belt 10. The cookies 100 at the time that they are transferred onto the conveyor belt 10 are generally randomly distributed. The conveyor belt 10 transports the cookies 100 to the apparatus of the present invention via guide member 11 in the form of a slide, which is used to accumulate the cookies in one or more of a plurality of rows. A conveyor belt 12 of the apparatus transports the cookies to an indexing station composed of a plurality of parallel guides 13, supported by a frame 14, extending downwardly from the frame 14 to very near the upper surface of the conveyor belt 12. The cookies 100 are then accumulated and sequentially released by indexing device 15, which brings each cookie into precise registration. The details of such an indexing device, are fully described in U.S. Pat. No. 4,535,881, known commercially as the ROTODEX TM indexing device, the disclosure of which is hereby incorporated by reference. It should be appreciated, however, that the present invention should not be limited by the use of any given indexing device.

The cookies are subsequently dropped from the conveyor belt 12 to a second conveyor belt 17, which is used to transport the rows of cookies transversely across a horizontal plane. Each row of cookies is conveyed to the end of the second conveyor 17 to abut against a series of stop pins 16. Stop pins 16 are positioned so as to bring each cookie of the row to a registered position; that is, each cookie row is now located at a known position on the second conveyor in synchrony with all other mechanical functions of the apparatus. The stop pins 16 are located closely adjacent to the end of the conveyor and protrude upwards approximately ¼ inch above the top surface of the conveyor. Immediately after the cookies come to rest against the stop pins 16, the cookies are removed from the conveyor by a pick-up device positioned above each cookie.

Figure 2:
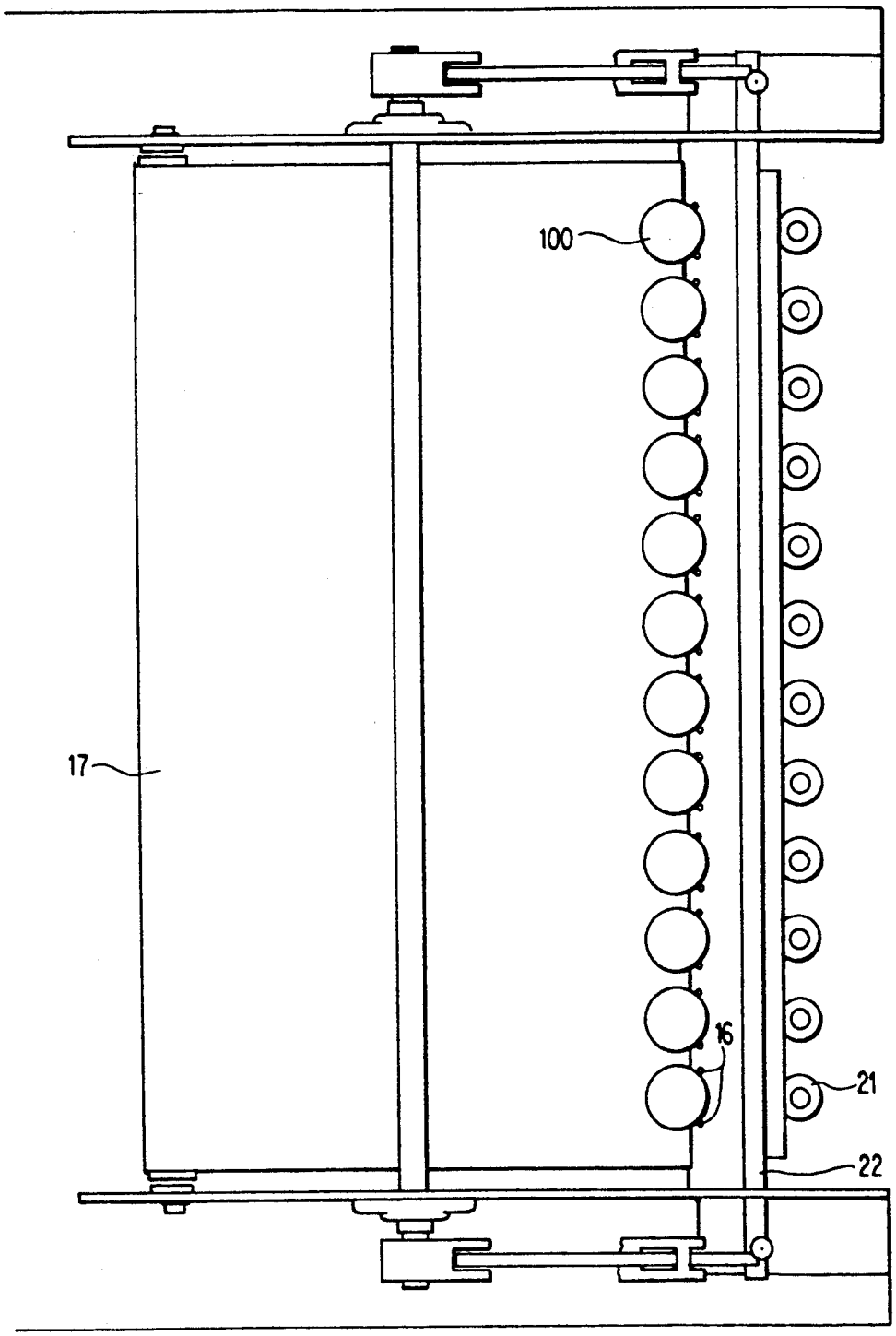
Figure 3:
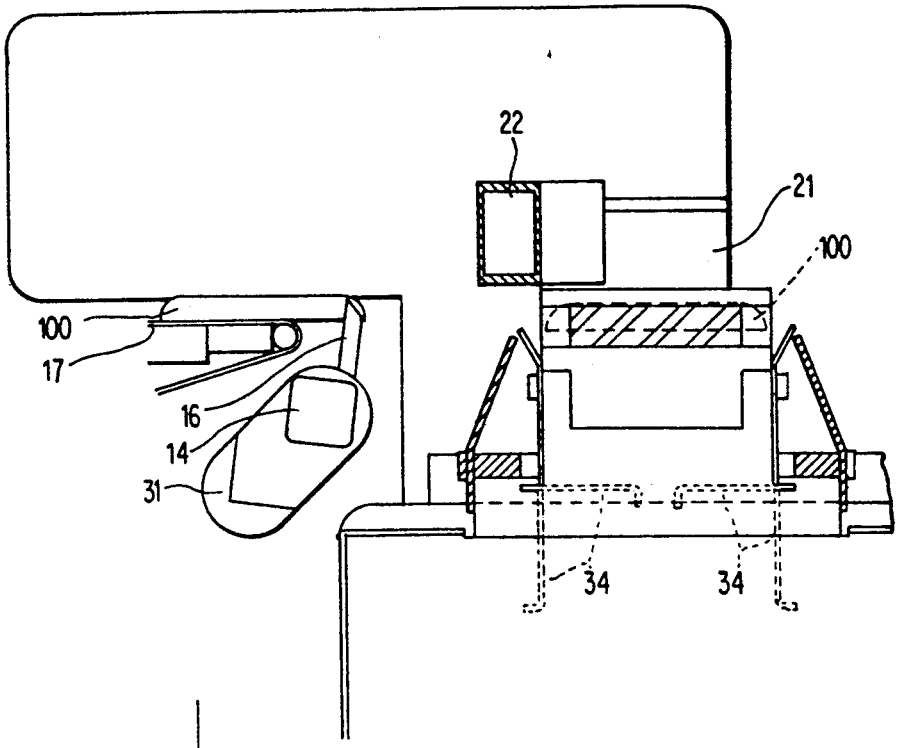
FIGS. 3, 4*a*, 4*d* and 5 illustrate a cross-sectional view of a collating device according to the preferred embodiment of the invention.
Figure 4A:
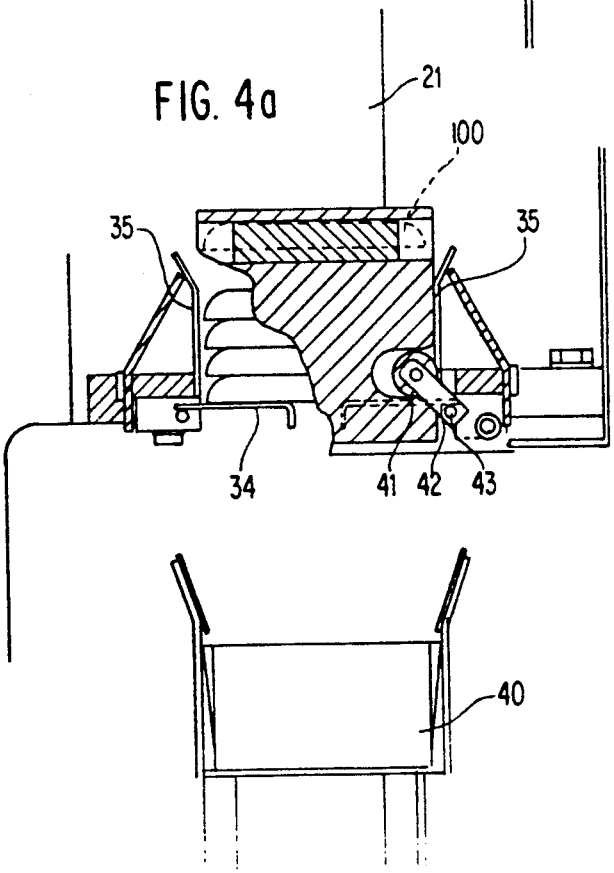
Figure 4D:
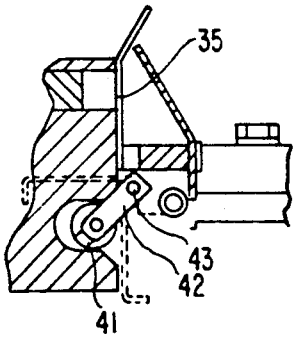
Figure 4B:
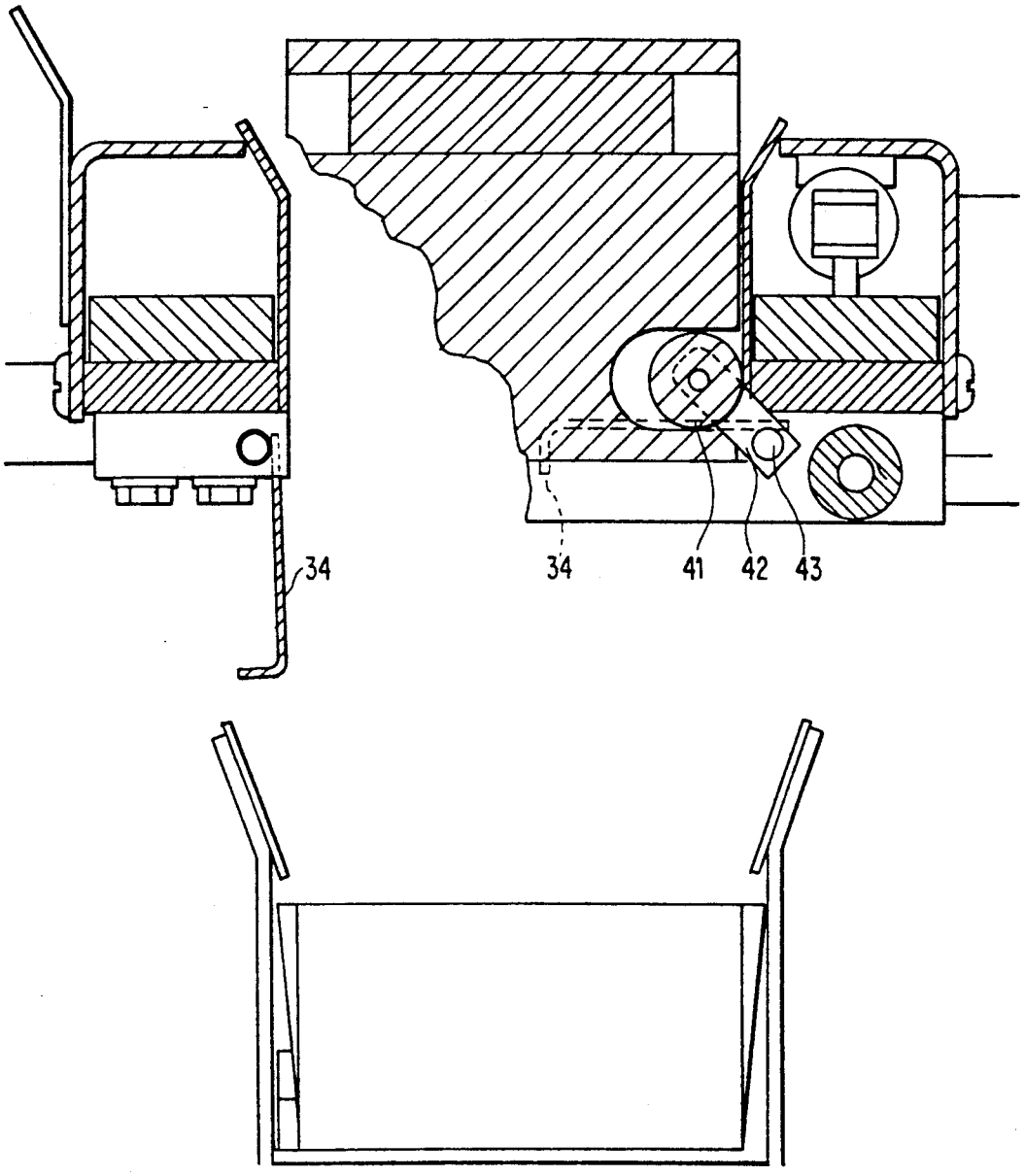
FIGS. 4*b* and 4*c* illustrate a cross-sectional view of a collating device according to another embodiment of the invention.
Figure 4C:
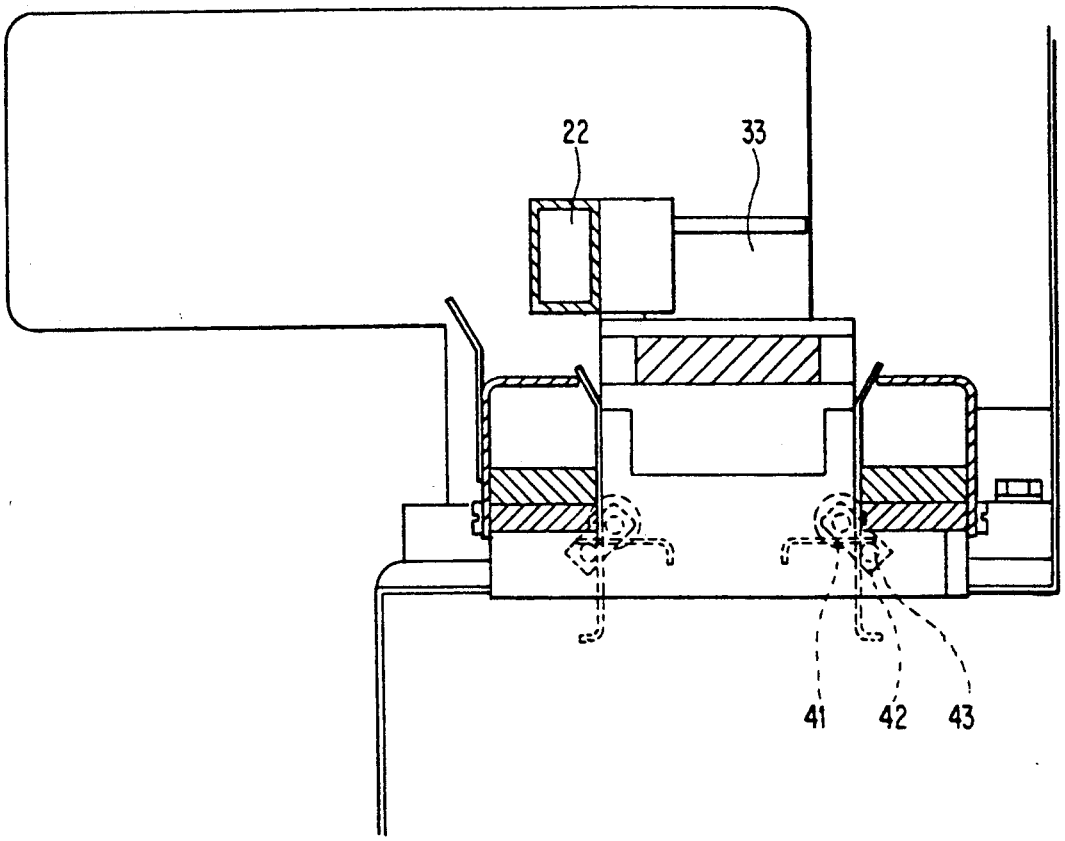

In the preferred embodiment, the pick-up device is a vacuum head 21, as shown in FIG. 2. As each row of cookies 100 approaches the end of the conveyor belt 17 and pins 16, the row of vacuum heads 21 mounted on bar 22 will be raised and positioned over the articles' predetermined positions as aligned by pins 16. The vacuum transfer heads 21 will then descend into engagement with the cookies and a vacuum created and applied, as is commonly known in the art, to remove the cookies from the conveyor as the heads 21 rise again. The succeeding row of cookies will then move beneath the raised cookies into abutment with the pins 16, in the same manner as described above. The vacuum head 21 will then be moved forward to a position directly over collator device 30 (FIG. 3).

In an alternative embodiment, the pins 16 may be lowered beneath the edge of the conveyor 17 when the vacuum heads 21 remove the cookies. Thus, if any cookies were not removed by the heads 21, such cookies would drop off the conveyor 17 and can then be recirculated or otherwise removed so that the path of the subsequent rows would not be impeded.

Figure 8A:
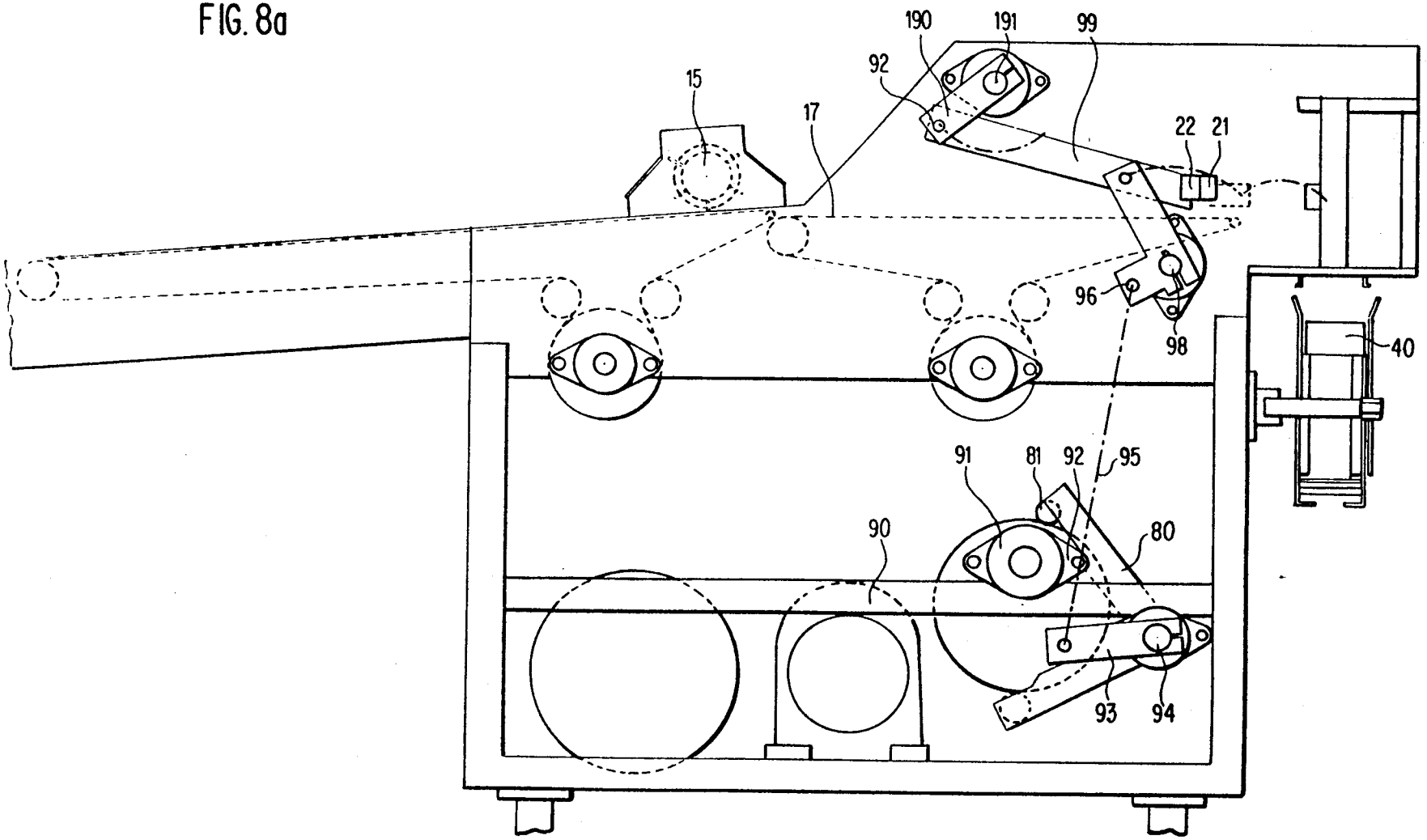
FIGS. 8*a* and 9 illustrate representative longitudinal-sectional views of an apparatus according to the preferred embodiment of the invention.
Figure 9:
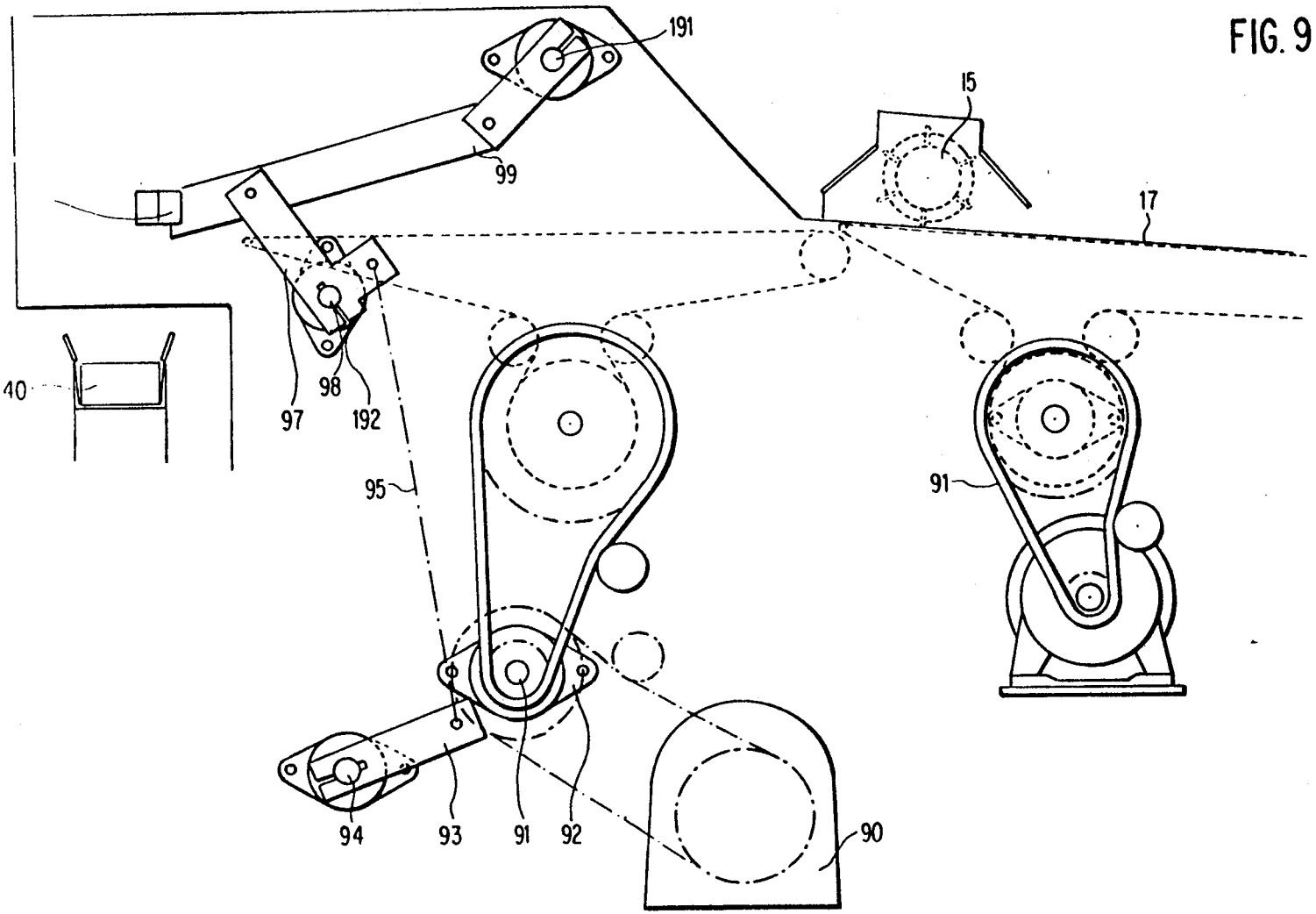

The dotted path shown in FIG. 8*a* is the locus of movement for the transfer head 21 and the bar 22. As shown in FIG. 8*a*,/more clearly shown in the encircled portion, the pick-up device as constructed is manipulated by a series of levers, from the pick-up position to a release position directly over top of the collator 30. As shown in FIG. 9, the heads 21 are mounted on an elongated bar 22 that stretches the entire lateral side or width of the conveyor 17. The bar 22 is integrally mounted on arm 99. One end of arm 99 is engaged to arm 190 by pivot 192, whereas the other end of arm 99 is engaged with lever 97 by pivot 193. The lever 97 is rotatably mounted on shaft 98, and movable in accordance with link 95 attached thereto by pivot 96. The link 95 is actuated by arm 93 that is connected to shaft 94. This shaft is rotated by cam follower lever 80 (FIG. 8*a*) so that the lever 80 follows a cam 92 using a roller 81. The cam 92 is ultimately driven by motor 90 so that the removal and deposit of one row of cookies occurs during one revolution of the cam 92.

Figure 8B:
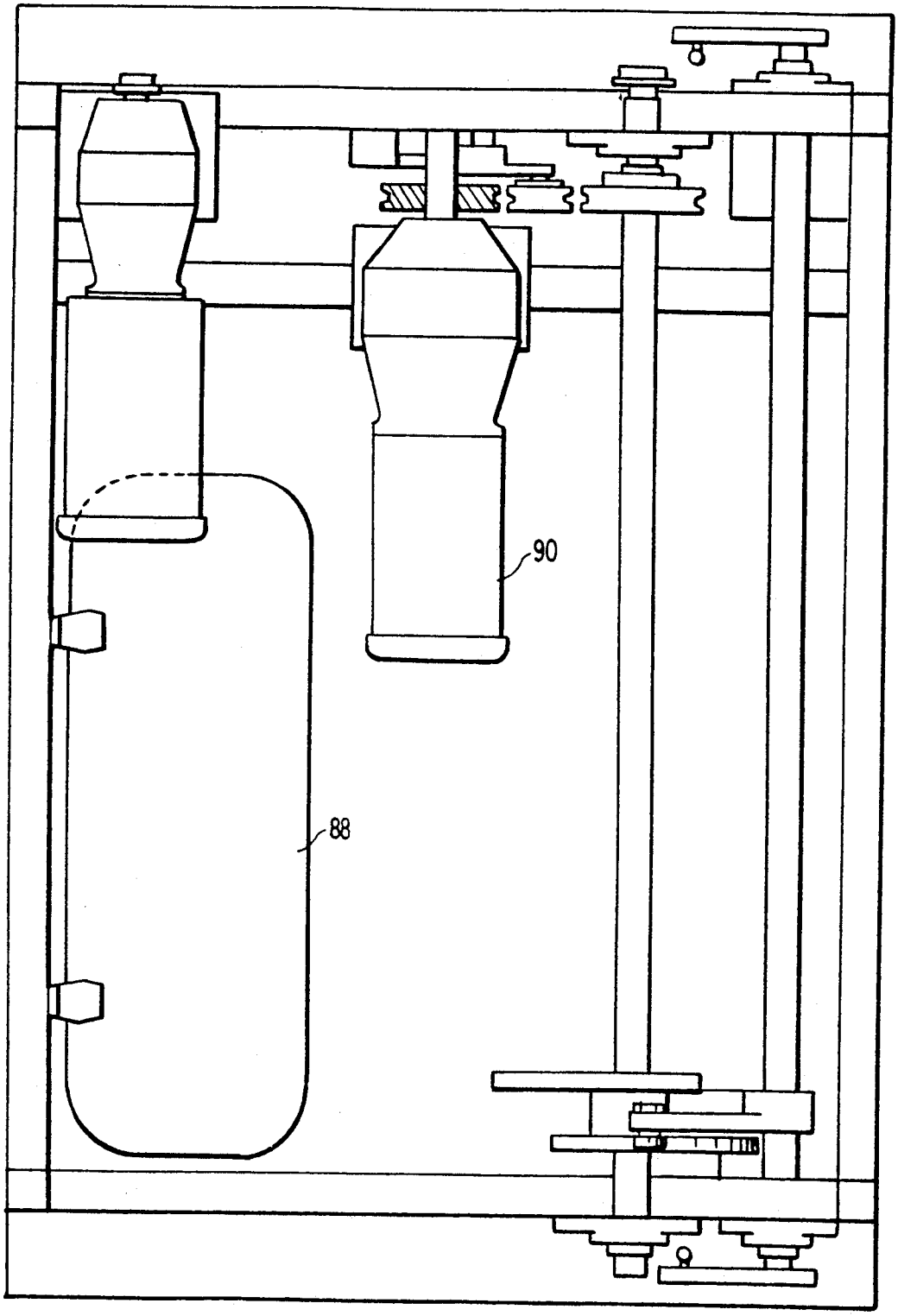
FIG. 8*b* illustrates a top-sectional view of an apparatus according to the preferred embodiment of the invention.

The pick-up device may be an air-operated venturi system which provides a venturi device and is supplied with air pressure through a common air manifold valve connected to air reservoir 88 (FIG. 8*b*).

Figure 5:
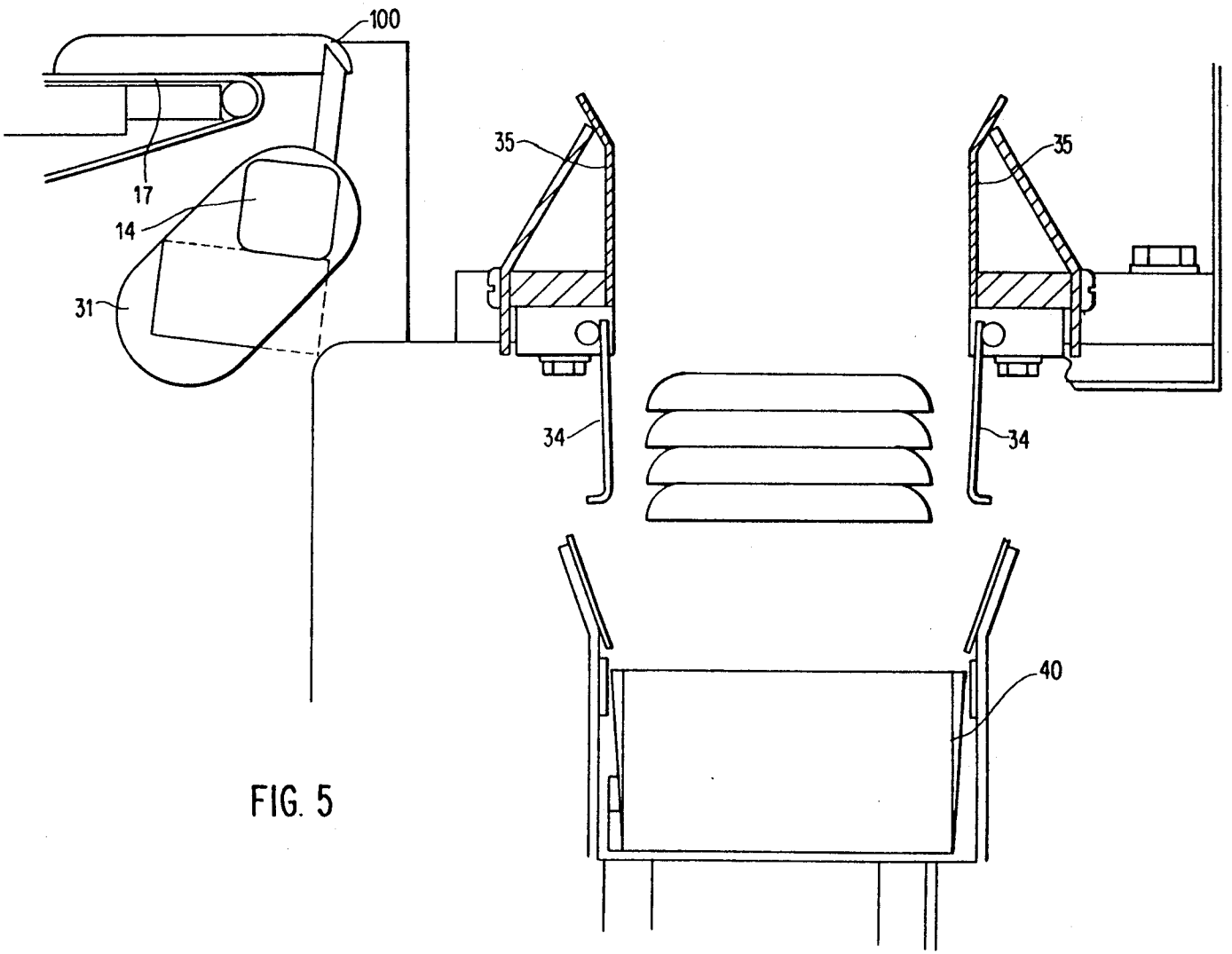

As shown in FIGS. 3–5, the cookie rows are carried from the pick-up device to a release position in successive cycles until the loading station receives a predetermined number of cookies in a horizontal stack. When the stack has reached this number, the bottom plates 34 of the collator 30 open downward to allow the stack of cookies to drop of their own free weight downward into tray 40 that had been previously positioned directly beneath the collator. As will be described later in more detail, concurrently with the successive placing of cookies into the collator 30, trays 40 are successively positioned directly beneath the collator for receiving each group of stacked cookies.

Figure 6:
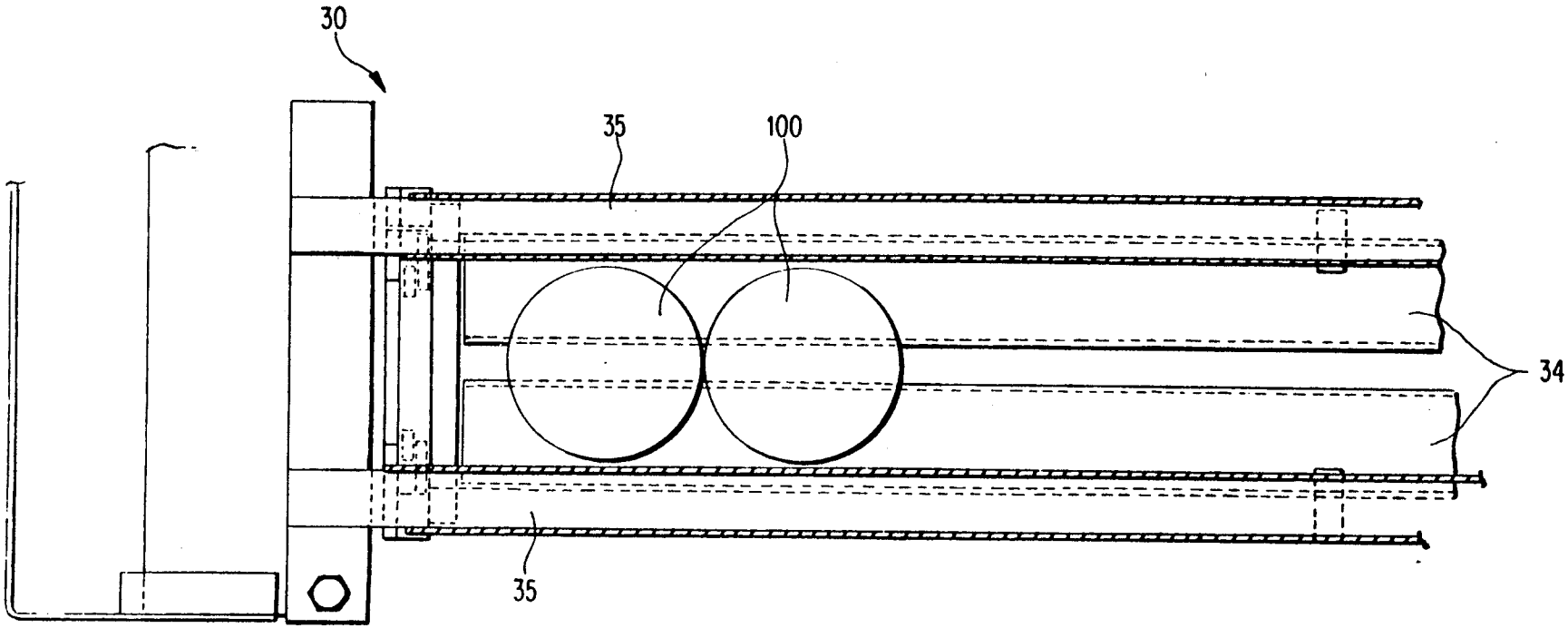
FIG. 6 illustrates a top view of a collating device according to the preferred embodiment of the invention.

As shown in FIG. 6, the collator 30 is composed of a chamber extending lengthwise across the width of the conveyor belt 17 to receive and collate a stack of cookies prior to depositing. The chamber consists of two vertical side walls 35 and two hinged panels or doors 34 on the bottom retained in the horizontal position so that the cookie stack can sit upon them until the group of cookies is deposited into the tray 40.

Figure 7:
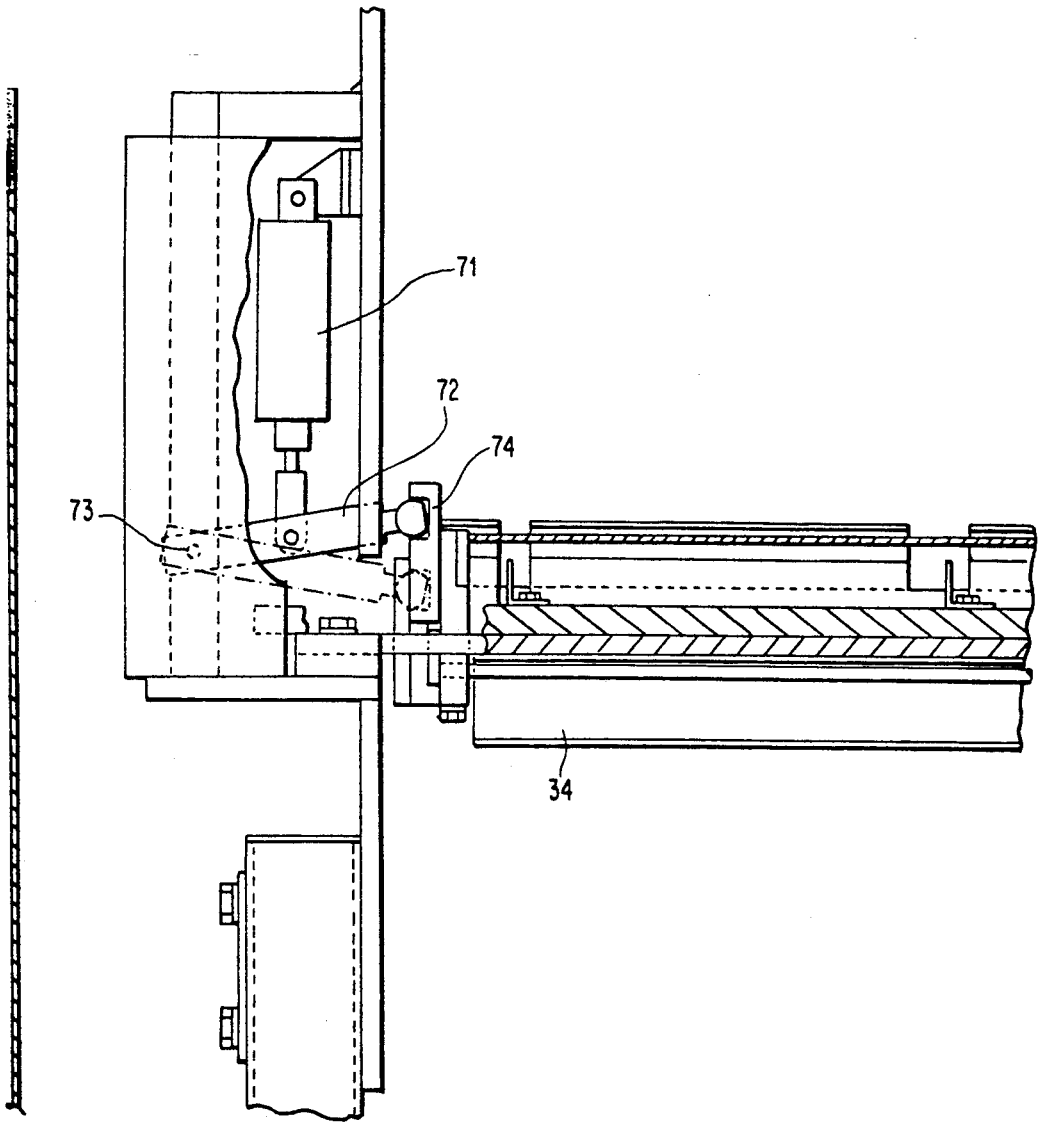
FIG. 7 illustrates a longitudinal-sectional view of a collating device according to the preferred embodiment of the invention.

As shown in FIG. 7, an air cylinder or similar actuator 71 includes a piston rod which is reciprocally movable and is connected in a suitable fashion to a pivotable actuating lever 72. The lever 72 is reciprocally movable with shaft 73 so as to actuate an arm 74 connected at the end of the lever 72 through a slot. Actuation of the air cylinder 71 causes downward movement of the lever 72, which in turn moves the arm 74 so that the panels 34 are rotated about associated pins to the discharge position shown in FIG. 5. As shown in FIGS. 3-5, the panels 34 can be so rotated by a combination of lever, roller, and slide mechanisms as is well recognized in the art.

The various cam shafts and conveyor shafts shown in FIGS. 8 and 9 are all driven in timed relation in a conventional manner and the orientation of the cams and cranks on the shafts are so as to accomplish the timing of events described in the operation of the apparatus and process above.

Figure 10A:
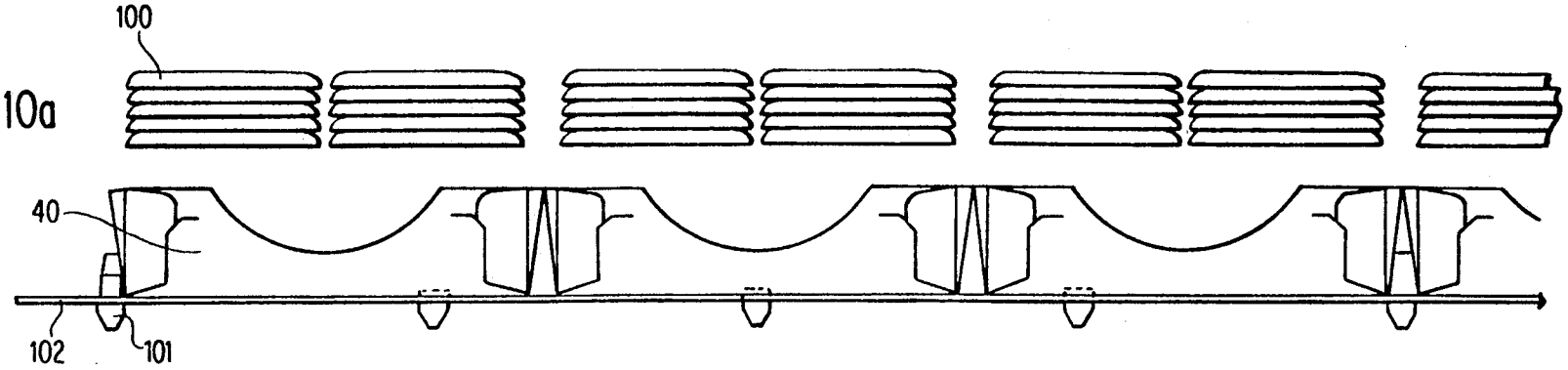
FIG. 10*a* illustrates the packaging process in accordance with the preferred embodiment of the present invention.
Figure 10B:
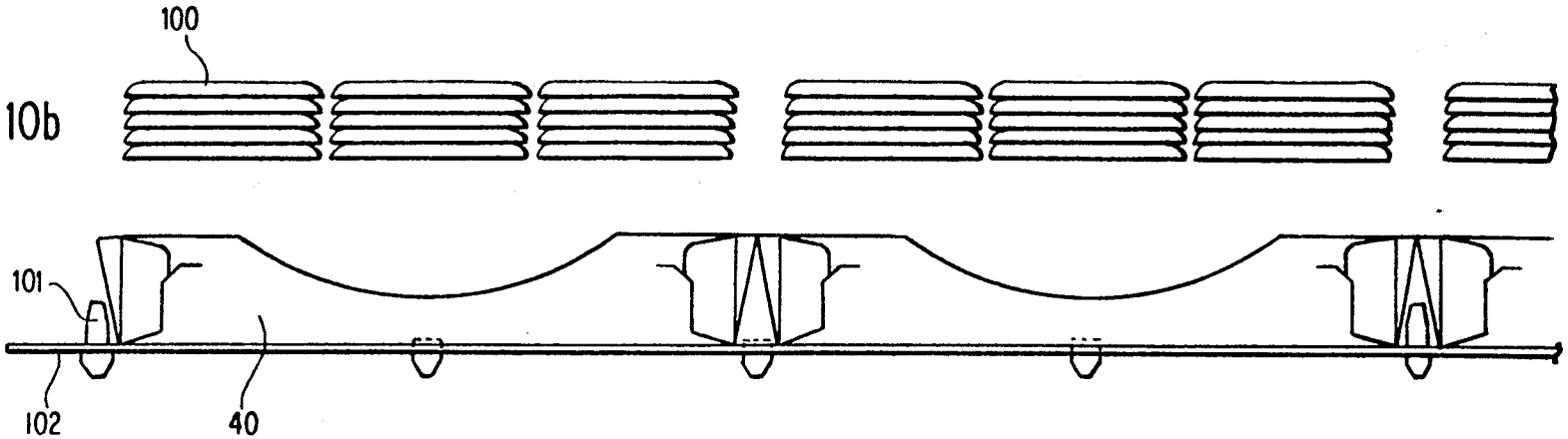
FIGS. 10*b*, 11*a* and 11*b* illustrate the packaging process in accordance with the preferred embodiment of the present invention.
Figure 11A:
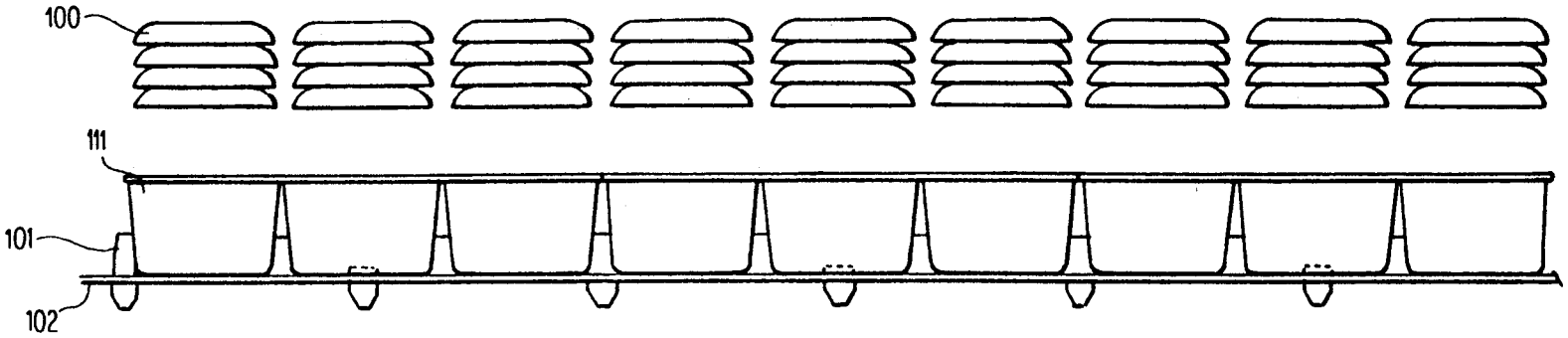
Figure 11B:
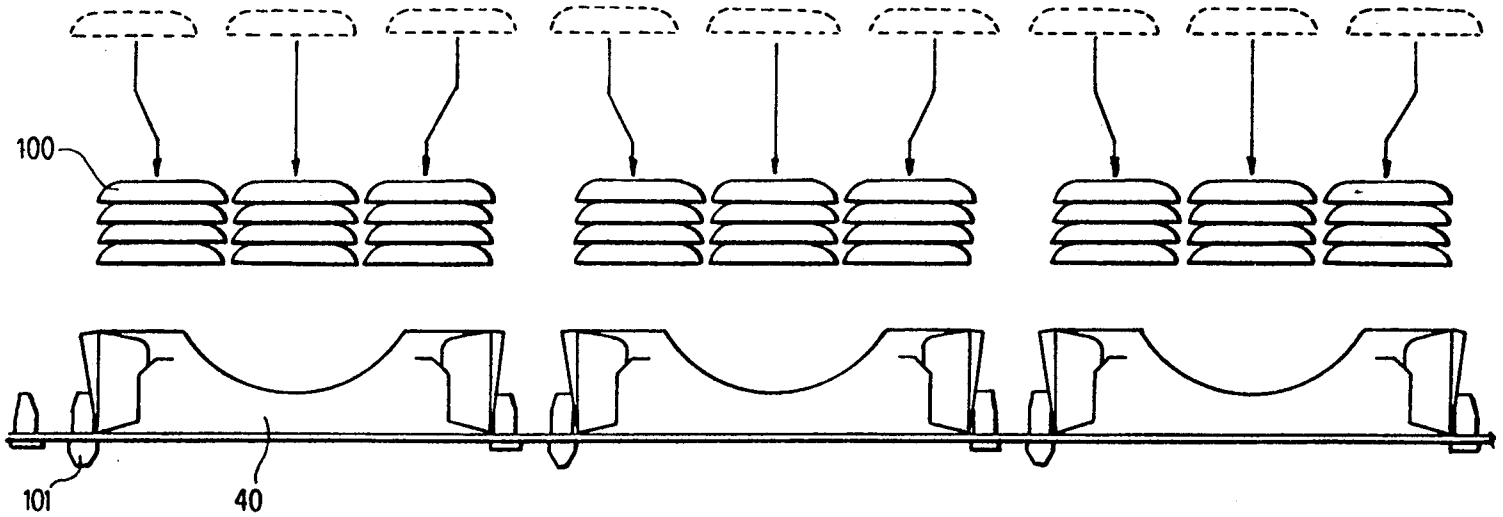

As shown in FIGS. 10*a-b* and 11*b*, the trays 40 are transported by a conveyor belt 102 as a serial stream of packages passing under the collator 30 (not shown in this figure) to receive horizontal stacks of cookies 100. The conveyor belt 102 has a series of equidistant lugs or flights 101 used to properly space the trays 40 so that they are in the proper position to receive the stacks of cookies 100. In an alternate embodiment, a series of cups 111 may be transported by the belt 102 and spaced by equidistant lugs or flights 101 so as to receive individual stacks of cookies 100, as shown in FIG. 11*a*. In order to more accurately position the trays 40 underneath the collator 30, it is preferable that the apparatus of the present invention use a tray indexing device to accumulate and register the trays 40 by successively releasing the trays in timed relation with the depositing of the stack of cookies 100. A tray indexing device that meets such requirements will now be described with reference to FIGS. 12-15.

Figure 12A:
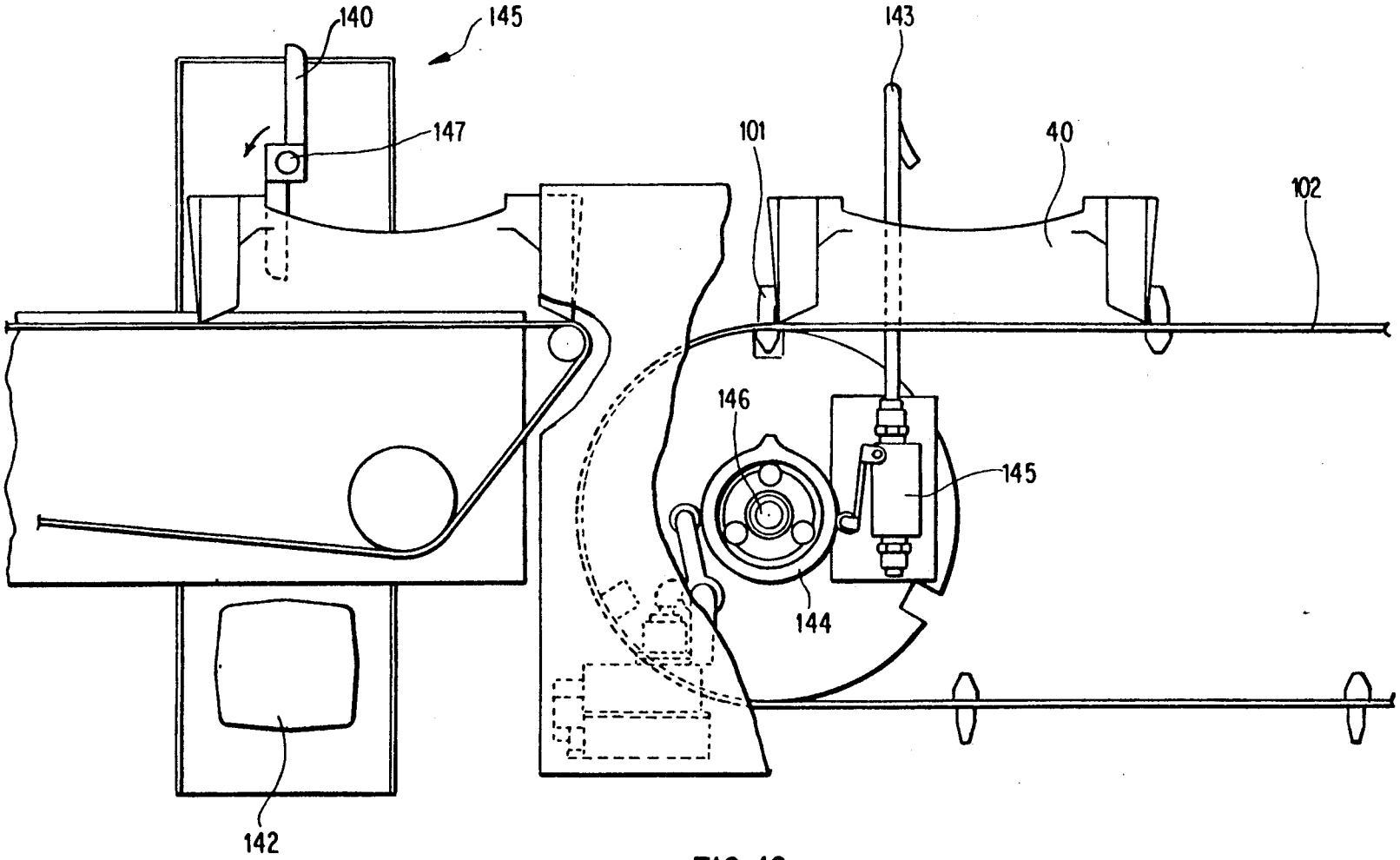
FIGS. 12*a* and 12*b* illustrate a longitudinal-sectional view of the package indexing station in accordance with the preferred embodiment of the present invention.
Figure 12B:
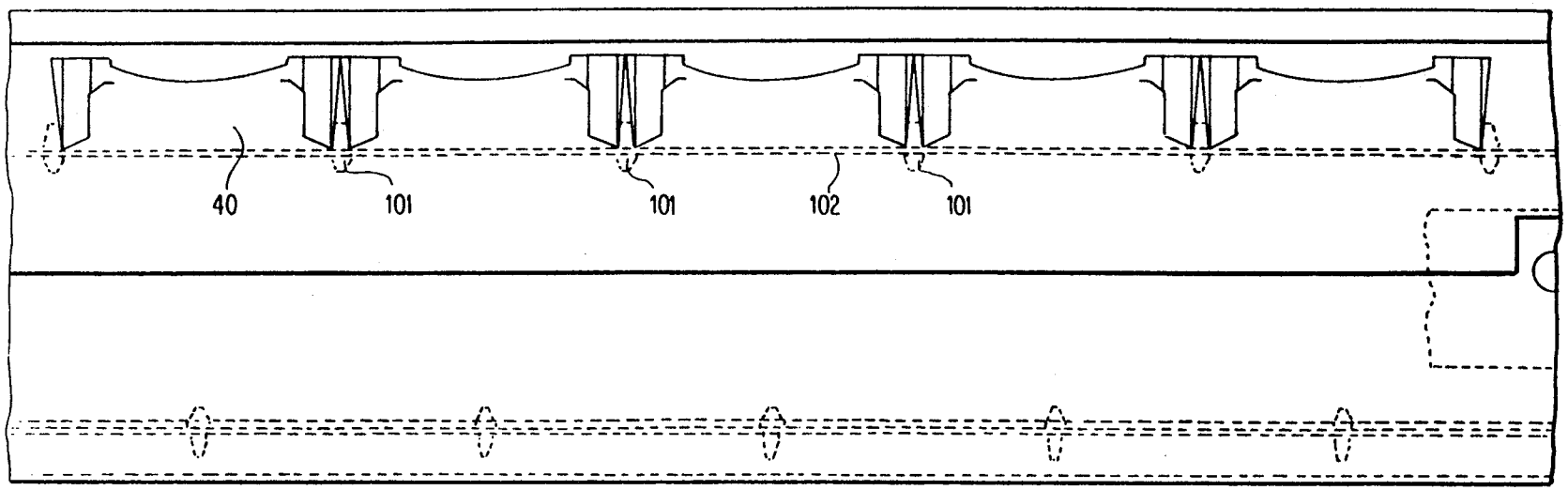
Figure 15:
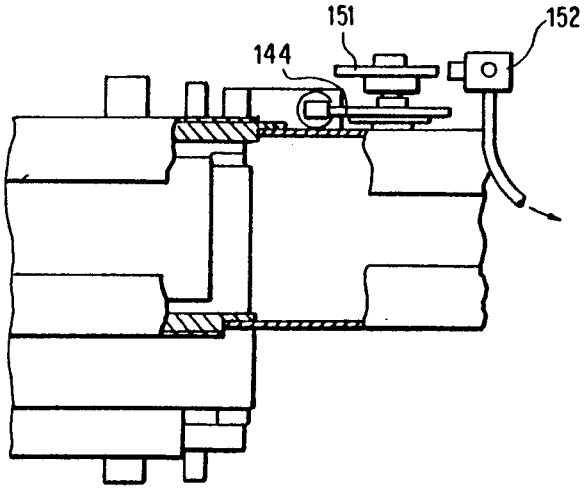
FIG. 15 illustrates a top-sectional view of the nudging or advancing station in accordance with the preferred embodiment of the present invention.
Figure 13:
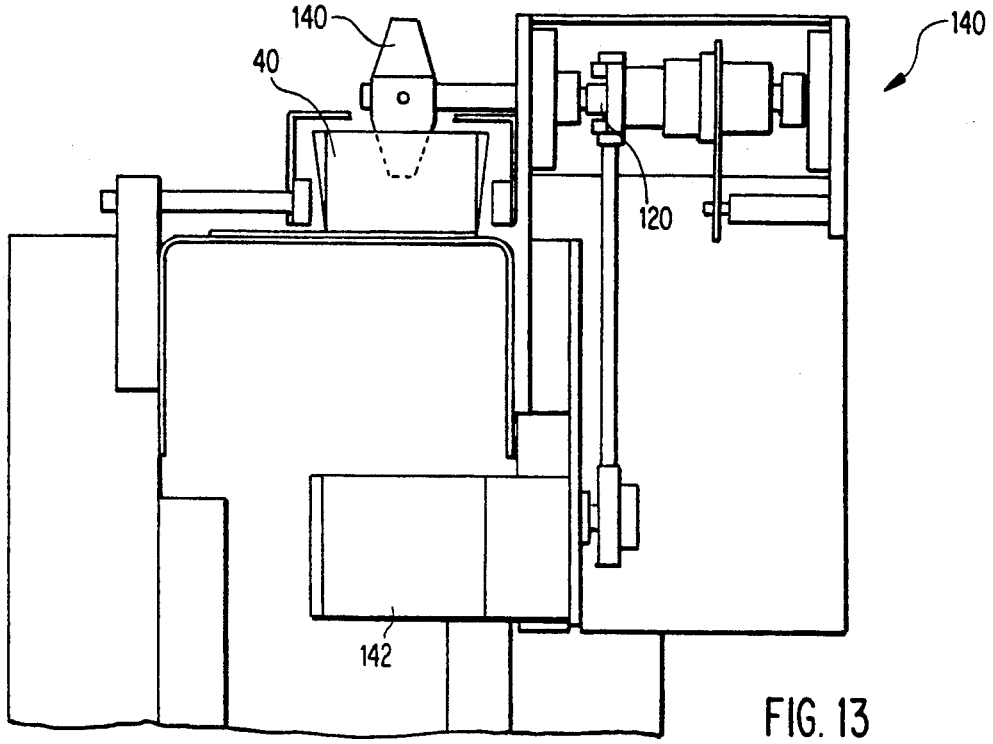
FIG. 13 illustrates a lateral-sectional view of the package indexing station in accordance with the preferred embodiment of the present invention.
Figure 14:
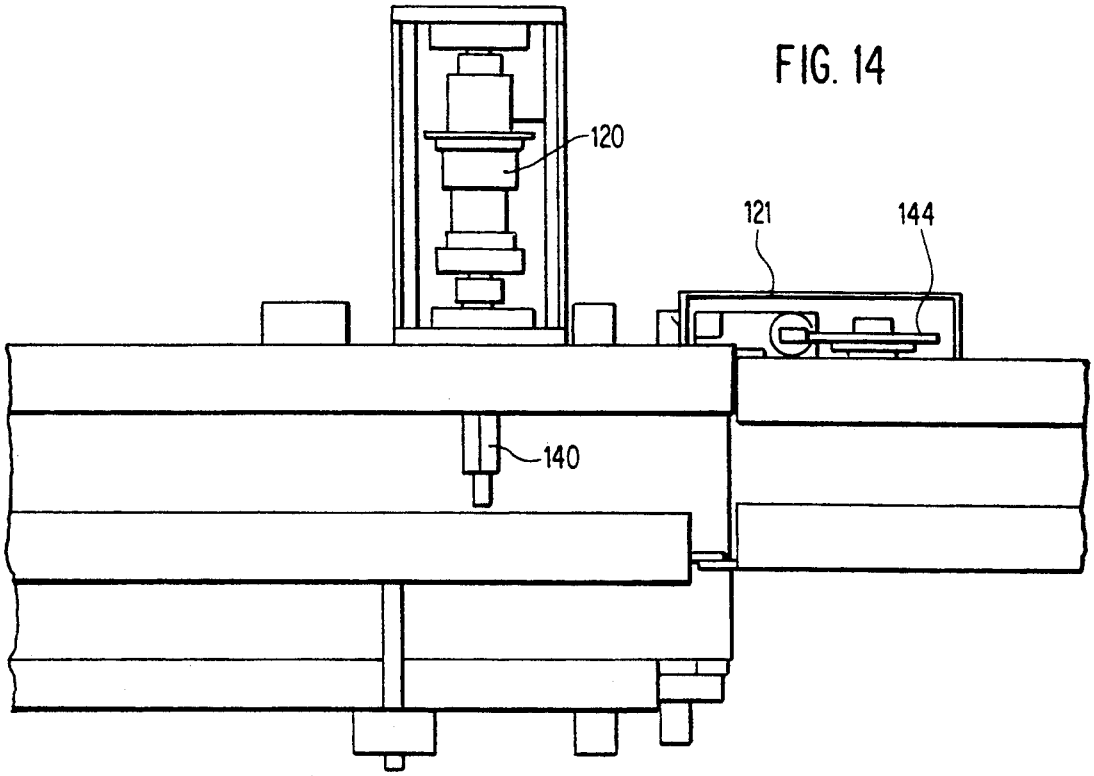
FIG. 14 illustrates a top-sectional view of the package indexing station in accordance with the preferred embodiment of the present invention.

As shown in FIGS. 12 and 13, a conveyor belt 141 transports a stream of trays 40 to an indexing station 145. The indexing device has a paddle 140 which intercepts the trays 40 at a top-end portion thereof. The rotatable paddle 140 is moved or rotated at a rate sufficient to retard the trays 40 slightly to make each tray fall behind a lug 101 of a downstream conveyor belt 102. The paddle 140 is mechanically linked to motor 142 through a ½ revolution clutch mechanism 120 (FIG. 14)(the clutch mechanism allows the paddle 140 to rotate one-half revolution per actuation). The clutch mechanism is activated by a trigger switch 121, which is itself actuated by a cam 144 coupled to the shaft of the conveyor belt 102 (FIGS. 12 and 13). Thus, as the conveyor belt 102 successively conveys lugs 101 traversely across the horizontal plane (shown in FIGS. 12 and 13), the paddle 140 successively rotates in half-revolution cycles to successively retard and subsequently release individual trays 40 to conveyor belt 102. The controlled retardation of the paddle 140 causes a gap between adjacent trays 40 such that the lug 101 on the conveyor belt 102 can be positioned in between the trays 40. Once the tray 40 passes from the conveyor belt 141 to the conveyor belt 102 behind the lug 101, the conveyor belt 102 transfers the tray 40 to air jet station 143. The air jet station 143 outputs a burst of air from an air nozzle in timed relation with the rotation of cam shaft 146 and cam 151 (FIG. 15). The cam 151 actuates an air valve 152 which is connected to an air source (not shown). The shot of air received by the tray 40 causes the front-end portion of the tray to abut the preceding lug 101 so that the tray 40 comes to rest at a registered position. This unique technique of positively registering position allows the apparatus to properly or more accurately position the trays 40 underneath the collator 30 as described above.

Figure 16:
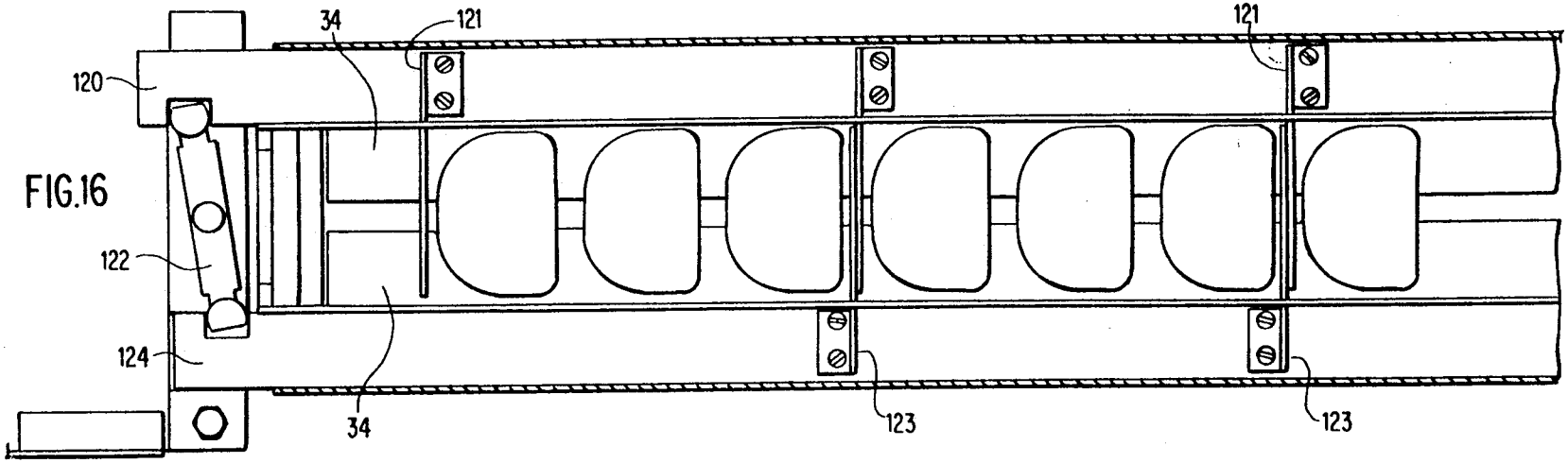
FIGS. 16 and 17 illustrate a top view of a collating device according to an alternate embodiment of the invention.
Figure 17:
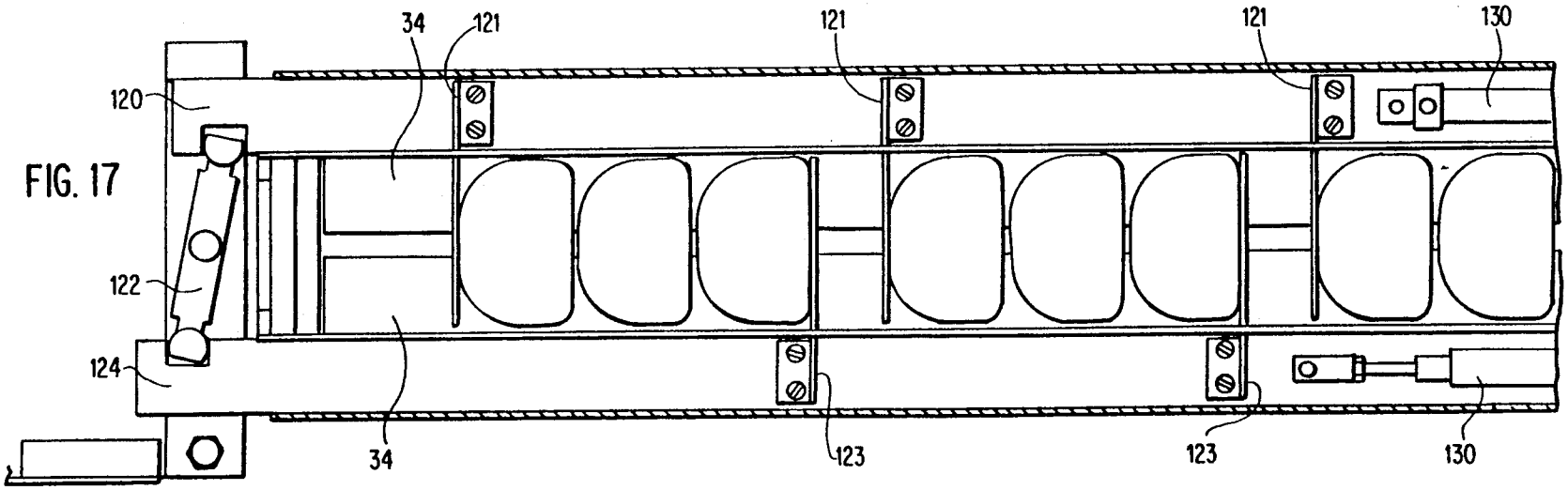
Figure 18:
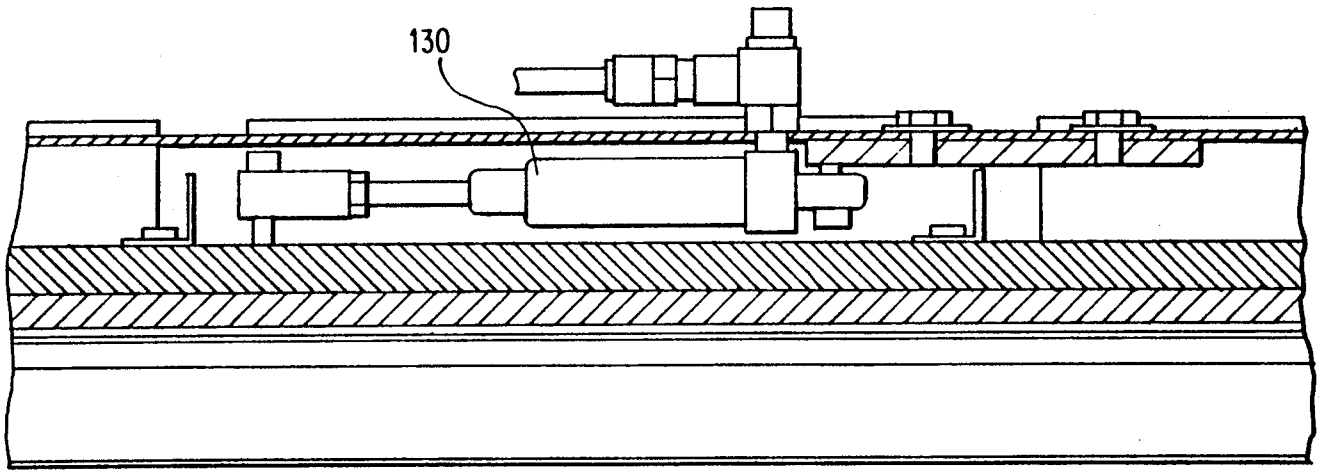
FIG. 18 illustrates a longitudinal-sectional view of a collating device according to an alternate embodiment of the invention.

While the invention has been particularly shown and described with reference to a preferred embodiment thereof, it will be understood that various changes in form and detail may be made therein without departing from the spirit and scope of the invention. For example, the packaging types, such as the tray-type and cup-type packages shown in FIGS. 10 and 11, respectively, may vary such that the distance between stacks of articles removed from the conveyor belt may be irregular. It should be appreciated that in an alternative embodiment, the pins appearing at the end surface of the conveyor belt 17, as shown in FIG. 2, may be successively shifted to the left or to the right to create the appropriate spacing required. In a further alternative, a series of paddles may be positioned within the collator 30, as shown in FIGS. 16 and 17, so that the vacuum transfer heads may remove the articles and place them in the collator, as in the embodiments described above, the paddles 121 and 123 may be lifted concurrently with the rotation of the lower panel 34, so that the articles 100 may be pressed or squeezed together to compensate for the irregular spacing distance required.

Although the present invention has been described with respect to food items such as cookies, and the like, it is obvious that the novel apparatus and process could readily be utilized for analagous operations, not only in food processing, but in manufacturing operations and the like.

What is claimed is:

1. An automatic packaging apparatus comprising:

conveying means for conveying a plurality of rows of articles transversely across a first plane;

grouping means for inhibiting at least one row of said articles from being conveyed across said first plane without inhibiting conveyance of others of said rows of articles, and grouping said at least one row of articles in a given aligned position; and transfer means for removing said at least one row of articles from said aligned position by picking up said at least one row of articles from said first plane and depositing such articles in a collator means, which is used for temporarily holding said articles in a substantially horizontal plane, prior to depositing such articles in a package.

2. The automatic packaging apparatus of claim 1, further comprising:

package delivering means for delivering at least one serial stream of packages across a second plane;

indexing means for receiving said serial stream of packages and sequentially inhibiting the delivery of each package received so as to allow a lug to be inserted between two adjacent packages within said stream, and for advancing each package so as to abut an upstream lug portion of said package delivering means.

3. The automatic packaging apparatus of claim 1, wherein said transfer means successively places said articles in said collator means to form a row of stacked articles, said collator depositing the row of stacked articles in a package in response to a number of successive placements having been made.

4. The automatic packaging apparatus of claim 3, further comprising package conveying means for conveying a serial stream of packages to a position to receive groups of stacked articles from said transfer means.

5. The automatic packaging apparatus of claim 4, wherein said serial stream of packages is a stream of tray-like packages positioned by lugs equally spaced on a conveyor belt.

6. The automatic packaging apparatus of claim 5, wherein said articles are cookies.

7. A packaging index device comprising:

first conveying means for conveying a stream of packages from a package supplier;

second conveying means for conveying the packages to a position to receive articles from an article transfer means;

index means for accumulating packages from said first conveying means, and for synchronizing release of such packages to said second conveying means, wherein said index means comprises a rotatable member whose rotation retards forward motion of the packages conveyed by said first conveying means so that a package is subsequently released by the rotatable member in synchrony with an indexed portion of said second conveying means.

8. A packaging index device comprising:

first conveying means for conveying a stream of packages from a package supplier;

second conveying means for conveying the packages to a position to receive articles from an article transfer means;

index means for accumulating packages from said first conveying means, and for synchronizing release of such packages to said second conveying means, wherein said index means comprises a rotatable member whose rotation retards forward motion of the packages conveyed by said first conveying means so that a package is subsequently released by the rotatable member in synchrony with an indexed portion of said second conveying means, wherein said second conveying means comprises a jet air device for exposing said packages to a burst of air so as to align the same with an indexed portion of said second conveying means.

9. A process of automatically packaging articles, comprising the steps of:

conveying a plurality of rows of articles transversely across a first plane;

inhibiting at least one row of said articles from being conveyed across said first plane without inhibiting conveyance of others of said rows of articles, and grouping said at least one row of articles in a given aligned position; and removing said at least one row of articles from said aligned position by picking up said at least one row of articles from said first plane and temporarily holding such articles in a substantially horizontal plane prior to depositing such articles in a package.

10. The automatic packaging process of claim 9, wherein the temporary holding step comprises the step of placing said articles in the substantially horizontal plane to form a row of stacked articles, and dumping the row of stacked articles in the package in response to a number of successive placements having been made.

* * * * *